US006861028B2

(12) United States Patent
Ozaki et al.

(10) Patent No.: US 6,861,028 B2
(45) Date of Patent: Mar. 1, 2005

(54) LUBRICANTS FOR DIE LUBRICATION AND MANUFACTURING METHOD FOR HIGH DENSITY IRON-BASED POWDER COMPACTS

(75) Inventors: Yukiko Ozaki, Chiba (JP); Satoshi Uenosono, Chiba (JP); Shigeru Unami, Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 147 days.

(21) Appl. No.: 09/817,171

(22) Filed: Mar. 27, 2001

(65) Prior Publication Data

US 2001/0038802 A1 Nov. 8, 2001

(30) Foreign Application Priority Data

Mar. 28, 2000 (JP) ..... 2000-089015
Feb. 21, 2001 (JP) ..... 2001-045036

(51) Int. Cl.[7] ..... B22F 3/12
(52) U.S. Cl. ..... 419/38; 419/36; 419/37; 425/78
(58) Field of Search ..... 419/38, 36, 37; 425/78

(56) References Cited

U.S. PATENT DOCUMENTS

| | | | |
|---|---|---|---|
| 4,225,546 | A | 9/1980 | Ohno |
| 5,256,185 | A | 10/1993 | Semel et al. |
| 5,368,630 | A | 11/1994 | Luk |
| 5,682,591 | A | 10/1997 | Inculet et al. |
| 6,355,208 | B1 | 3/2002 | Unami et al. |

FOREIGN PATENT DOCUMENTS

| | | | |
|---|---|---|---|
| EP | 0 468 278 | A1 | 1/1992 |
| EP | 0 576 282 | A2 | 12/1993 |
| EP | 0 913 220 | A1 | 5/1999 |
| EP | 1 145 788 | A1 | 10/2000 |
| JP | A-2-156002 | | 6/1990 |
| JP | A-7-103404 | | 4/1995 |
| JP | A-8-100203 | | 4/1996 |
| JP | 11-193404 | | 7/1999 |
| JP | 2000-290703 | | 2/2001 |

OTHER PUBLICATIONS

Ball et al., "The International Journal of Powder Metallurgy", vol. 33, No. 1, 1997, pp. 23–30.
Bocksteigel et al., "The Influence of Lubrication, Die Material and Tool Design Upon Die–Wear in the Compacting of Iron Powders," *Processes. Proceedings of the 1970 International Powder Metallurgy Conference*, vol. 4, pp 87–114, New York.

*Primary Examiner*—Daniel Jenkins
(74) *Attorney, Agent, or Firm*—Oliff & Berridge, PLC

(57) ABSTRACT

A manufacturing method for high-density iron-based powder compacts is disclosed. The temperature of the die is adjusted at ordinary temperature or at a predetermined temperature by preheating. A lubricant for die lubrication prepared by mixing at least two different lubricants having melting points higher than a predetermined temperature of the compaction pressure is sprayed at the upper part of the die and is introduced into the die and adhered by electrification to the surface of the die. The resulting die is filled with an iron-based mixed powder including a lubricant and molding is performed at ordinary temperature or at a temperature raised by heating. The at least two different lubricants having melting points higher than the predetermined temperature of the compaction pressure are preferably at least two materials selected from at least one of the following groups: metallic soaps, amide-based waxes, polyamides, polyethylenes, polypropylenes, polymers comprised of acrylic acid esters, polymers having methacrylic acid ester, plastics including fluorine and lubricants having layered crystal structures.

30 Claims, No Drawings

LUBRICANTS FOR DIE LUBRICATION AND MANUFACTURING METHOD FOR HIGH DENSITY IRON-BASED POWDER COMPACTS

BACKGROUND OF THE INVENTION

1. Field of Invention

This invention relates to lubricants for die lubrication and a manufacturing method for an iron-based powder compact for powder metallurgy.

2. Description of Related Art

In general, iron-based powder compacts for powder metallurgy are manufactured by the steps of mixing an iron-based powder, an alloy powder, for example, a copper powder and a graphite powder, and furthermore, a lubricant, for example, zinc stearate and lead stearate, to prepare an iron-based mixed powder; filling a die with the iron-based mixed powder; and performing pressure molding. Densities of the resulting compacts are generally 6.6 to 7.1 $Mg/m^3$.

These iron-based powder compacts are subjected to sintering to make sintered materials, and are further subjected to sizing and cutting as necessary to make powder metallurgy products. In cases in which further increased strength is required, a carburization heat-treatment, or a bright heat-treatment, may be performed after completion of the sintering.

By using this powder metallurgy technique, it has become possible to produce nearly final shape, that is, "near net shape", complicatedly shaped components with high dimensional accuracy by one-time molding without many steps of cutting works. Therefore, it has become possible to decrease cutting costs to a great extent as compared to conventional manufacturing methods. As a consequence, iron-based powder metallurgy products were used as components of automobiles in an amount exceeding 6 kg per automobile in 1998 in Japan. Recently, it is strongly required of iron-based powder metallurgy products that there be a further improvement in dimensional accuracy in order to decrease costs by omitting the cutting works and that there be an increase in strength in order to produce miniaturized and lightweight components.

In order to increase the strength of powder metallurgy products (sintered components), it is effective to increase the density of sintered components by increasing the density of compacts. Accompanying the increase in the density of sintered components, cavities in the components are decreased, and mechanical properties, for example, tensile strength, impact value, and fatigue strength are improved.

As a compaction method capable of increasing the density of iron-based powder compacts, the twice compaction and twice sintering method, in which iron-based mixed powder is subjected to ordinary compaction and sintering, and thereafter, is subjected to another compaction and sintering, and the sintering and forging method, in which after once compacting and once sintering are performed, hot forging is performed, have been suggested.

Furthermore, for example, the warm compaction technique, in which metallic powders are molded while being heated is disclosed in Japanese Unexamined Patent Application Publication No. 2-156002, Japanese Examined Patent Application Publication No. 7-103404 and U.S. Pat. Nos. 5,256,185 and 5,368,630. This warm compaction technique is intended to decrease frictional resistance between the particles and between the compact and the die, and to improve the compactibility by a portion of, or by the entirety of the lubricant, being fused during the warm molding, and thereby, being uniformly dispersed between the powder particles. It is believed that this warm compaction technique has the most advantageous cost among the above-mentioned manufacturing methods for high-density compacts. According to this warm compaction technique, an iron-based mixed powder prepared by blending 0.5% by weight of graphite and 0.6% by weight of lubricant to Fe-4Ni-0.5Mo-1.5Cu partially alloyed iron powder can be molded at 130° C. and at a pressure of 7 $t/cm^2$ (686 MPa) to produce a compact having a density of about 7.30 $Mg/m^3$.

According to the techniques described in Japanese Unexamined Patent Application Publication No. 2-156002, Japanese Examined Patent Application Publication No. 7-103404 and U.S. Pat. Nos. 5,256,185 and 5,368,630, however, because the fluidity of the powder mixture is insufficient, there have been problems in that the productivity is decreased, unevenness occurs in the density of the compact, and the properties of the sintered material fluctuate. Furthermore, there have been problems in that because a large ejection force is required during compacting, flaws are generated at the surface of the compact, and the lifetime of the die is decreased.

Furthermore, in these warm compaction techniques, the lubricant is contained in the iron-based mixed powder in order to decrease frictional resistance between the particles and between the compact and the die and to improve the compactibility. A part of, or the entirety of, the lubricant is, however, fused during the warm compaction so as to be pushed out to the vicinity of the surface of the compact. During the subsequent sintering, the lubricant is pyrolyzed or vaporized and dissipated from the compact and coarse cavities are formed in the vicinity of the surface of the sintered material. Therefore, there has been a problem that the mechanical strength of the sintered material is decreased.

In order to solve this problem, in Japanese Unexamined Patent Application Publication No. 8-100203, a technique in which in ordinary temperature compaction or in warm compaction, the surface of the die is coated with an electrified lubricant powder to decrease the amount of the lubricant in the iron-based mixed powder and to achieve a high-density compact. According to this method, however, because only one kind of lubricant for die lubrication is applied by coating, the shape of the lubricant changes near its melting point so that the function of lubricating changes to a great extent. As a consequence, there has been a problem in that the range of the compacting temperature is restricted by the melting point of the lubricant Even when the surface of the die is coated with a lubricant for die lubrication to decrease the amount of the lubricant in the iron-based mixed powder, there is still a problem that some components of the mixed lubricant cannot exhibit the effect of lubricating due to the decrease in the amount and an increase in green density is not achieved.

Commercially available lubricants for die lubrication are intended for use at room temperature. Therefore, when these commercially available lubricants for die lubrication are adhered by electrification to preheated dies, there are problems that the lubricants may be completely fused on the surface of the dies and not uniformly adhered, and the lubricants are likely to move during the compaction pressure, such that the compact and the surface of the dies may be directly contacted so as to increase the ejection force.

Accordingly, there is a strong demand for an ordinary temperature compaction technique in which high-density compacts can be produced by one time compacting at room temperature. As the above-mentioned ordinary temperature compaction technique, a molding technique using die lubrication has been attempted as described, for example, in W. G. Ball et al., The International Journal of Powder Metallurgy, APMI International, vol.33, No.1, 1997, pp.23–30. In the case in which the die is coated with a commercially available lubricant for die lubrication using a conventional die lubrication apparatus, however, the lubricant is not uniformly dispersed and adhered to the surface (wall) of the die with a high degree of reproducibility even at room temperature. Consequently, this technique has not yet become industrially practical.

In addition, from the viewpoint of increasing the strength of automobile components, and from the viewpoint of cost, there has been a demand for developing a manufacturing method for a high-density iron-based powder compact that can produce a compact having higher density can be produced by one time compacting.

SUMMARY OF THE INVENTION

Objects of this invention are to solve the above-mentioned problems of conventional techniques, and to provide manufacturing methods for high-density iron-based powder compacts.

In embodiments, an iron-based mixed powder prepared by blending 0.5% by weight of graphite to a partially alloyed iron powder having a composition of Fe-4Ni-0.5Mo-1.5Cu is subjected to an ordinary temperature compaction pressure at room temperature and at a pressure of 7 t/cm$^2$ (686 MPa), and high-density compacts having a density of at least about 7.30 Mg/m$^3$ can be produced by one time compacting. When subjected to warm compaction pressure at 130° C. and at a pressure of 7 t/cm$^2$ (686 MPa), high-density compacts having a density of at least about 7.40 Mg/m$^3$ can be produced by one time compacting.

In order to achieve the above-mentioned objects using a die lubricating compaction technique, the present inventors earnestly researched combinations of lubricants for die lubrication. As a consequence, it was discovered that in order to decrease the ejection force, a mixture (lubricant) of at least two kinds of lubricants, each having a melting point higher than the predetermined temperature of the compaction pressure, is effective as a lubricant for die lubrication which can adhere by electrification to the surface of a die that is at room temperature or preheated.

This invention was completed based on the above-mentioned discovery and further studies.

That is, a first aspect of this invention is a lubricant for die lubrication used during compaction pressure of a powder with a die while the lubricant is adhered by electrification to the surface of the die. The lubricant is comprised of a mixed powder of at least two kinds of lubricants each having a melting point higher than a predetermined temperature of the compaction pressure. In the first aspect of this invention, the above-mentioned at least two kinds of lubricants each having a melting point higher than a predetermined temperature of the compaction pressure are preferably at least two materials selected from at least one of the following groups:

group A: metallic soaps;

group B: polyethylenes;

group C: amide-based waxes;

group D: polyamides;

group E: polypropylenes;

group F: polymers composed of acrylic acid esters;

group G: polymers composed of methacrylic acid esters;

group H: plastics including fluorine; and group I: lubricants having layered structure.

In the first aspect of this invention, the die is preferably a preheated die.

A second aspect of this invention is a manufacturing method for high-density iron-based powder compacts including filling a die with an iron-based mixed powder and performing compaction pressure at a predetermined temperature, in which the die has the surface to which a lubricant for die lubrication is adhered by electrification, and a mixed powder of at least two kinds of lubricants each having a melting point higher than a predetermined temperature of the compaction pressure is used as the above-mentioned lubricant for die lubrication. In the second aspect of this invention, the above-mentioned at least two kinds of lubricants each having a melting point higher than the predetermined temperature of the compaction pressure are preferably at least two materials selected from at least one of the following groups:

group A: metallic soaps;

group B: polyethylenes;

group C: amide-based waxes;

group D: polyamides;

group E: polypropylenes;

group F: polymers composed of acrylic acid esters;

group G: polymers composed of methacrylic acid esters;

group H: plastics including fluorine; and group I: lubricants having layered structure In the second aspect of the invention, the die is preferably a preheated die and the above-mentioned iron-based mixed powder is preferably a pre-heated powder.

In the second aspect of the invention, the above-mentioned iron-based mixed powder is a mixture of the iron-based powder and a lubricant (lubricant for compacted powder), or is a mixture further comprising a powder for alloying. The content of the lubricant for compacting powder (means additive amount hereinafter) is preferably 0.05 to 0.40% by weight relative to the entire iron-based mixed powder. In the second aspect of the invention, the lubricant for compacting powder is preferably at least one kind of lubricant having a melting point higher than a predetermined temperature of the compaction pressure, or more preferably, is a mixed lubricant including a lubricant having a low melting point equivalent to, or lower than, the predetermined temperature of the compaction pressure and a lubricant having a melting point higher than the predetermined temperature of the pressure molding. In this case, the content of the above-mentioned lubricant having a low melting point equivalent to, or lower than, the predetermined temperature of the compaction pressure is preferably 10 to 75% by weight relative to the entirety of the contained lubricant for compacting powder, and the content of the lubricant having a melting point higher than the predetermined temperature of the pressure molding is preferably the balance of 25 to 90% by weight.

According to this invention, a high-density compact can be produced with one time of compaction pressure.

DETAILED DESCRIPTION OF PREFERRED EMBODIMENTS

In the invention, a die is filled with an iron-based mixed powder, and then compaction pressure is performed at a predetermined temperature, that is, at ordinary temperature, or at "warm" temperature of about 70 to about 200° C., to produce an iron-based powder compact.

In the invention, the die for compacting is used at ordinary temperature without preheating in the ordinary compaction temperature, or the die is used after being preheated to a predetermined temperature in the warm compaction. The preheating temperature of the die is not specifically limited as long as the iron-based mixed powder can be kept at the predetermined temperature of the compaction pressure. The preheating temperature is preferably about 20 to 60° C. higher than the predetermined temperature of the compaction pressure. In the ordinary compaction temperature, even if the die is used without being first preheated, the temperature of the die is raised to about 80° C. after a plurality of uses.

An electrified lubricant for die lubrication is introduced into the die so that it is adhered by electrification to the surface of the die. The lubricant for die lubrication (solid powder) is preferably put into a die lubrication apparatus, for example, the Die Wall Lubricant System manufactured by Gasbarre Products, Inc., and is electrified by contact electrification of the lubricant (solid) and the inner wall of the apparatus. The electrified lubricant for die lubrication is sprayed at the upper part of the die, and is introduced into the die so that it adheres by electrification to the surface of the die. The lubricant (lubricant for die lubrication) adhered to the surface of the die can decrease frictional resistance between the surface (wall) of the die and the powder during the compaction of the iron-based powder so as to decrease "pressure loss", that is, the escape of compaction pressure to the surface (wall) of the die, and to effectively transfer the pressure to the powder. Therefore, the density of the compact is increased and the ejection force required for ejecting the compact from the die is decreased. In order to achieve the above-mentioned effects, the lubricant powder must be uniformly adhered to the surface of the die. In order to be uniformly adhered to the surface of the die, the lubricant for die lubrication (solid powder) is preferably adhered by electrification.

In order to be adhered to the surface of the die with reliability, the lubricant for die lubrication (solid powder) must be reliably electrified in a charging device of the die lubrication apparatus. For this purpose, the specific surface area of the lubricant for die lubrication (solid powder) is preferably small, that is, the particle diameter is preferably small. In the invention, the particle diameters of 90% or more of the lubricant for die lubrication (solid powder) are preferably about 50 $\mu$m or less. When the particle diameters exceed about 50 $\mu$m, the electrification may become insufficient, and furthermore, the lubricant may fall under its own weight after being adhered to the die so that the adherence of the lubricant to the surface of the die becomes insufficient.

In the invention, as the lubricant for die lubrication (solid powder), at least two kinds of different powder materials (lubricant powders) are mixed and used. By mixing the at least two kinds of different lubricant powders, not only the lubricant for die lubrication (solid powder) is electrified in the die lubrication apparatus (charging device), but also the at least two kinds of different powders are contacted with each other in the die lubrication apparatus (charging device) so as to be contact electrified. Accompanying this, the amount of electrical charge on the entirety of the powders becomes greater than that in the case in which one kind of lubricant is used. Therefore, the lubricant powders are adhered to the surface of the die with reliability. In the invention, as the lubricant for die lubrication (solid powder), a mixed powder prepared by mixing at least two kinds of lubricants each having a melting point higher than the predetermined temperature of the compaction pressure is used. Herein, the predetermined temperature of the compaction pressure in the invention means the temperature at the surface of the die during the compaction pressure.

Because the lubricant for die lubrication has a melting point higher than the predetermined temperature of the compaction pressure, the lubricant is not fused and is present as a solid powder on the surface of the die so that the function of lubricating on the surface of the die is maintained, the density of the compact is increased, and the ejection force is not increased. On the other hand, when the lubricant for die lubrication has a melting point lower than the predetermined temperature of the compaction pressure, the lubricant fuses on the surface of the die and spreads in a liquid state. This is advantageous from the viewpoint of uniform adhesion, although there are problems in that the lubricant flows out of the surface of the die, or even if the lubricant does not flow out, the lubricant may be suctioned into the powder by a capillary phenomenon during the compaction of the iron-based mixed powder so that the lubricant remaining on the surface of the die may be decreased. Accompanying this, the function of lubricating on the surface of the die may be reduced and the ejection force may be increased.

The lubricant for die lubrication having a melting point higher than the predetermined temperature of the compaction pressure is not fused in the die during the compaction, and functions as a solid lubricant like a "roller" in the die so as to also have an effect of decreasing the ejection force.

As the lubricant (solid powder) having the melting point higher than the temperature of the compaction pressure, at least two powder materials selected from at least one of the following groups are preferred:

group A: metallic soaps;

group B: polyethylenes;

group C: amide-based waxes;

group D: polyamides;

group E: polypropylenes;

group F: polymers composed of acrylic acid esters;

group G: polymers composed of methacrylic acid esters;

group H: plastics including fluorine; and group I: lubricants having layered structure These at least two lubricants (powders) are mixed and the resulting mixture is used as the lubricant for die lubrication.

The lubricant for die lubrication according to the invention may be at least two materials selected from the group A consisting of metallic soaps, or it may be at least one material selected from the group A consisting of metallic soaps and at least one material selected from the other groups B-I. Similar combinations of materials can be selected for each of other groups.

Exemplary materials classified as metallic soaps of group A include, for example, lithium stearate, lithium laurate, lithium hydroxystearate, and calcium stearate. Other suitable materials can also be used.

Exemplary materials classified as polyethylenes of group B include, for example, polyethylenes having different molecular weights. Among these materials, a polyethylene powder having a molecular weight of 5,000 to 100,000 is preferred.

Exemplary materials classified as amide-based waxes of group C include, for example, stearic acid amide (melting point 103° C.), ethylene-bis-stearoamide (melting point 148° C.), and long-alkyl chain ethylene-bis-alkylamides, e.g., Light Amide WH215 manufactured by Kyoeisha Kagaku Co., Ltd., (melting point 215° C.), Light Amide WH255 manufactured by Kyoeisha Kagaku Co., Ltd., (melting point 255° C.). Other suitable amide-based waxes can also be used.

Exemplary materials classified as polyamides of group D include, for example, polyamides having different molecular weights. Among these materials, polyamides having a melting point of 210 to 270° C. (nylon) are preferred.

Exemplary materials classified as polypropylenes of group E include, for example, polypropylenes having different molecular weights. Polypropylene powders having a molecular weight of 5,000 to 100,000 are preferred.

Exemplary materials classified as polymers comprised of acrylic acid esters of group F, include polymers of the same kind of monomers and copolymers of a plurality of kinds of monomers, such as, for example, polymethylacrylate and polyethylacrylate. Other suitable acrylic acid ester polymers can also be used.

Exemplary materials classified as polymers comprised of methacrylic acid esters of group G include polymers of the same kind of monomers and copolymers of a plurality of kinds of monomers, for example, polymethylmethacrylate and polymethylmethacrylate. Other suitable methacrylic acid ester polymers can also be used.

Exemplary materials classified as plastics including fruorine of group H include polymers of the same kind of monomers and copolymers of a plurality of kinds of monomers, for example, polytetrafluoroethylene, tetrafluoroethylene-perfluoroalkylvinyl ether copolymer, and tetrafluoroethylene-hexafluoropropylene copolymer. Other suitable fluoroplastics can also be used.

Exemplary materials classified as lubricants having layered crystal structure of group I include inorganic or organic lubricants having layered crystal structures. Inorganic lubricants having layered crystal structures include, for example, graphite, $MoS_2$ and carbonfluoride. Organic lubricants having layered crystal structures include, for example, melamine-cyanuric acid adducts (MCA) and N-alkylaspartic acid-β-alkyl ester. Other suitable layered lubricants can also be used.

The adhesion amount of the lubricant for die lubrication adhered by electrification to the surface of the die is preferably about 0.5 to about 10 mg/cm$^2$. When the adhesion amount is less than about 0.5 mg/cm$^2$, the effect of lubricating is insufficient so that the ejection force after the compaction is increased. On the other hand, when the adhesion amount exceeds about 10 mg/cm$^2$, the lubricant remains on the surface of the compact so that the appearance of the compact becomes inferior.

The iron-based mixed powder is placed in the die to which the lubricant for die lubrication has been adhered by electrification, and compaction pressure is performed to produce the iron-based powder compact. In cases in which the die is used at ordinary temperature without preheating, the iron-based mixed powder is preferably also used at ordinary temperature without specific heating. On the other hand, in cases in which-the die is preheated, the iron-based mixed powder is preferably heated to a temperature of about 200° C. or less, preferably to a temperature of about 70° C. or more. When the heating temperature exceeds about 200° C., the density is not substantially increased, and the iron powder may be oxidized. Therefore, the heating temperature of the iron-based mixed powder is preferably about 200° C. or less.

The iron-based mixed powder is a mixture of the iron-based powder and a lubricant (lubricant for powder molding), or it is a mixture further comprising a powder for alloying.

As the iron-based powder in the invention, pure iron powders, for example, an atomized iron powder or a reduced iron powder, or partially alloyed steel powders, completely alloyed steel powders, or mixed powders thereof are preferable.

The mixing method for the iron-based powder and the lubricant for compacting powder, or for the iron-based powder, the lubricants for compacting powder, and the powder for alloying is not specifically limited, and any suitable mixing method can be used. In particular, in cases in which the iron-based powder is mixed with the powder for alloying, in order to prevent contained powders from segregating, a mixing method including the steps of primarily mixing the iron-based powder, the powder for alloying, and a portion of the lubricants for compacting powder; agitating the resulting mixture while heating to a temperature equivalent to or higher than the melting point of at least one kind of lubricant in the above-mentioned lubricants for compacting powder so as to fuse at least one kind of lubricant in the above-mentioned lubricants for compacting powder; cooling the mixture after the fusing while agitating so as to fix the fused lubricant to the surface of the above-mentioned iron-based powder, and thereby, to adhere the powder for alloying; then adding residual lubricants for compacting powder, and secondarily mixing is preferable.

The content of the lubricants for compacting powder in the iron-based mixed powder is preferably about 0.05% to about 0.40% by weight relative to the entire iron-based mixed powder. When the content of the lubricants for compacting powder is less than about 0.05% by weight, the effect of the powders lubricating each other during compacting is reduced so that the density of the compact is decreased. On the other hand, when the content of the lubricants for compacting powder exceeds about 0.40% by weight, the proportion of the lubricant having a smaller specific gravity is increased, so that the density of the compact is decreased.

In the invention, the lubricant for compacting powder in the iron-based mixed powder may preferably be each of at least one lubricant having a melting point higher than the predetermined temperature of the compaction pressure; a mixed lubricant including a lubricant having a low melting point equivalent to, or lower than, the predetermined temperature of the compaction pressure and a lubricant having a melting point higher than the predetermined temperature of the compaction pressure; and at least one lubricant having a low melting point equivalent to, or lower than, the predetermined temperature of the compaction pressure. Among those, the mixed lubricant including the lubricant having a low melting point equivalent to, or lower than, the predetermined temperature of the compaction pressure and the lubricant having a melting point higher than the predetermined temperature of the compaction pressure is preferred.

In cases in which the mixed lubricant including the lubricant having a low melting point equivalent to, or lower than, the predetermined temperature of the compaction pressure and the lubricant having a melting point higher than the predetermined temperature of the compaction pressure is used, the content of the lubricant having a low melting point equivalent to, or lower than, the predetermined temperature of the compaction pressure is preferably about 10% to about 75% by weight relative to the entire contained lubricants for powder compacting, and the content of the lubricant having a melting point higher than the predetermined temperature of the compaction pressure is preferably the balance of 25 to 90% by weight. The lubricant having a low melting point equivalent to, or lower than, the predetermined temperature of the compaction pressure is fused during the compaction pressure, penetrated between the particles of the powder by capillary force, and is uniformly dispersed in the particles of the powder so as to decrease the contact resistance between the particles, accelerating the rearrangement of the particles, and accelerating the increase in density of the compact. When the content of the lubricant having a low melting point equivalent to, or lower than, the predetermined temperature of the compaction pressure is less than about 10% by weight, the lubricant is not uniformly dispersed in the particles of the powder so that the density of the compact is decreased. When the content exceeds about 75% by weight, accompanying the increase in density of the compact, fused lubricant is squeezed out to the surface of the compact, escape paths of the lubricant are formed on the surface, and many coarse cavities are formed on the surface of the compact, so that the strength of the sintered material is decreased.

The lubricant having a melting point higher than the predetermined temperature of the compaction pressure contained in the iron-based mixed powder is present in the solid state during the compacting, and functions as a "roller" at convex portions of the surface of the iron-based mixed powder at which the fused lubricant is repelled so as to accelerate the rearrangement of the particles and increase the density of the compact.

Regarding the lubricants for powder compacting contained in the iron-based mixed powder, as the lubricant having a melting point higher than the predetermined temperature of the compaction pressure, at least one lubricant selected from the group consisting of metallic soaps, thermoplastic resins, thermoplastic elastomers, and inorganic or organic lubricants having layered crystal structures is preferable. This lubricant is appropriately selected from the lubricants described below in accordance with the predetermined temperature of the compaction pressure.

As the metallic soap, lithium stearate, lithium hydroxystearate and the like are preferable. As the thermoplastic resin, polystyrene, polyamide, plastics including fluoride, and the like, are preferable. As the thermoplastic elastomer, polystyrene-based elastomers, polyamide-based elastomers, etc., are preferable. As the inorganic lubricant having a layered crystal structure, each of graphite, $MoS_2$ and fluorocarbon can be used and the ejection force is effectively decreased with a decrease in particle size. As the organic lubricant having a layered crystal structure, each of melamine-cyanuric acid adducts (MCA) and N-alkylaspartic acid-β-alkyl ester can be used.

Regarding the lubricants for compacting powder contained in the iron-based mixed powder, as the lubricant having a low melting point equivalent to, or lower than, the predetermined temperature of the compaction pressure, at least one lubricant selected from the group consisting of metallic soaps, amide-based waxes, polyethylenes, and eutectic mixtures of at least two lubricants are preferable. This lubricant is appropriately selected from the lubricants described below in accordance with the predetermined temperature of the compaction pressure.

As the metallic soap, zinc stearate, calcium stearate, and the like, are preferable. As the amide-based wax, ethylene-bis-stearoamide, stearic acid monoamide, and the like, are preferable. As the eutectic mixture, a eutectic mixture of oleic acid and zinc stearate; a eutectic mixture of ethylene-bis-stearoamide and polyethylene; a eutectic mixture of ethylene-bis-stearoamide and stearic acid amide; a eutectic mixture of ethylene-bis-stearoamide and zinc stearate; a eutectic mixture of ethylene-bis-stearoamide and calcium stearate; a eutectic mixture of calcium stearate and lithium stearate, and the like, are preferable. Depending on the compaction temperatures, a portion of these lubricants may be used as a lubricant having a melting point higher than the temperature of the compacting pressure.

The graphite contained in the iron-based mixed powder as a powder for alloying has the effect of strengthening the sintered material. When the content of the graphite is decreased, the effect of strengthening the sintered material is insufficient. On the other hand, when the content is overly increased, initial deposition cementite is deposited, which decreases the strength. Therefore, the content of the graphite in the iron-based mixed powder is preferably about 0. 1% to about 2.0% by weight relative to the entire iron-based mixed powder.

The compact produced as described above is subjected to a sintering treatment, and furthermore can be subjected, for example, to a carburization heat-treatment, a bright heat-treatment as necessary, so as to be used as a powder metallurgy product.

EXAMPLES

As an iron-based powder, a partially alloyed steel powder having a composition of Fe-4Ni-0.5Mo-1.5Cu was used. This partially alloyed steel powder was mixed with a graphite powder and lubricants for powder molding by a heat mixing method using a high-speed mixer so as to produce an iron-based mixed powder. The additive amount of the graphite was 0.5% by weight relative to the entire iron-based mixed powder. The kinds and the additive amounts relative to the entire iron-based mixed powder of the lubricants for compacting powder were as shown in Tables 1-1 to 1-3 below.

The temperature of the die for the compacting pressure was adjusted as shown in Tables 1-1 to 1-3, that is, at ordinary temperature, or to temperatures raised by preheating. A lubricant for die lubrication electrified using a die lubrication apparatus (manufactured by Gasbarre Products, Inc.) was sprayed and introduced into the die so as to be adhered by electrification to the surface of the die. The lubricant for die lubrication was a mixture of at least two kinds of lubricants having melting points higher than the temperature of the compaction pressure, and was prepared by mixing at least two kinds of materials (lubricants) selected from at least one group of the groups A to I as shown in Table 2. For purposes of comparison, cases in which at least one kind of lubricant having a melting point less than the temperature of the compaction pressure was used and cases in which one kind of lubricant having a melting point higher than the temperature of the compaction pressure was used were used as Comparative Examples. The measured temperature of the surface of the die was taken as the temperature of the compaction pressure.

The die treated as described above was filled with the iron-based mixed powder. The temperature of the iron-based mixed powder was adjusted at ordinary temperature or to temperatures raised by heating in accordance with the treatment of the die. Then, compaction pressure was performed so as to produce a compact in the shape of a rectangular parallelepiped of 10 mm×10 mm ×55 mm dimension. The applied pressure was 7 t/cm$^2$ (686 MPa). The compaction pressure conditions used are shown in Tables 1-1 to 1-3. The lubricants for compacting powder in the iron-based mixed powder were selected from various lubricants as shown in Table 2, and the lubricants having melting points higher than the temperature of the pressure molding as shown in Tables 1-1 to 1-3, or the mixtures of the lubricants having low melting points equivalent to, or lower than, the temperature of the compaction pressure and lubricants having melting points higher than the temperature of the compaction pressure as shown in Table 1-2, were used.

As Conventional Examples, a die not coated with a lubricant for die lubrication was filled with the iron-based mixed powder. The temperature of the iron-based mixed powder was adjusted at ordinary temperature (25° C.) or at temperatures raised by heating in accordance with the treatment of the die. Then, compaction pressure was performed so as to produce compacts (Compact Nos. 28 and 32) in the shape of a rectangular parallelepiped similar to that of the above-mentioned Example.

After completion of compacting, ejection forces for ejecting the compacts were measured.

Regarding the resulting compacts, the densities were measured by the Archimedes method, which is a method for determining the density based on the volume and buoyancy of the compact measured by soaking it in water.

Furthermore, appearances of the resulting compacts were visually observed for the presence or absence of defects such as flaws and fractures.

The resulting compacts were cut at their centers, embedded in a resin and polished. Thereafter, the presence or absence of a coarse cavity in the cross section was observed with an optical microscope.

The results for ejection forces, densities of the compacts, appearances of the compacts, and properties of sectional microstructures of the compacts are shown in Tables 1-1 to 1-3.

TABLE 1-1

| | Lubricant for Die Lubrication | | | | Lubricant for Powder Molding in Iron-Based Mixed Powder | | | | |
|---|---|---|---|---|---|---|---|---|---|
| | Lubricant Having Melting Point Higher Than Temperature of Pressure Molding | | Lubricant Having Low Melting Point Equivalent to or Lower Than Temperature of Pressure Molding | | | Lubricant Having Melting Point Higher Than Temperature of Pressure Molding | | Lubricant Having Low Melting Point Equivalent to or Lower Than Temperature of Pressure Molding | |
| Compact No. | Content* % by weight | Kind (Melting Point) | Content* % by weight | Kind (Melting Point) | Lubricant Content** % by weight | Kind (Melting Point): Content % by weight*** | Content* % by weight | Kind (Melting Point): Content % by weight*** | Content* % by weight |
| 1 | 50<br>50 | A1(150° C.)<br>A3(230° C.) | — | — | 0.4 | C1(148° C.):0.4 | 100 | — | — |
| 2 | 25<br>75 | A1(150° C.)<br>A4(216° C.) | — | — | 0.3 | C1(148° C.):0.3 | 100 | — | — |
| 3 | 25<br>75 | A4(216° C.)<br>H1(327° C.) | — | — | 0.3 | J1(about 140° C.):0.3 | 100 | — | — |
| 4 | 50<br>50 | G1(160° C.)<br>C1(148° C.) | — | — | 0.05 | C1(148° C.):0.05 | 100 | — | — |
| 5 | 50<br>50 | A3(230° C.)<br>D2(260° C.) | — | — | 0.1 | C1(148° C.):0.1 | 100 | — | — |
| 6 | 25<br>75 | A4(216° C.)<br>B1(144° C.) | — | — | 0.2 | C1(148° C.):0.2 | 100 | — | — |
| 7 | 80<br>20 | A3(230° C.)<br>E1(153° C.) | — | — | 0.3 | J2(about 135° C.):0.3 | 100 | — | — |
| 8 | 50<br>50 | A3(230° C.)<br>F1(155° C.) | — | — | 0.3 | J3(about 149° C.):0.3 | 100 | — | — |
| 9 | 30<br>70 | C1(148° C.)<br>C2(215° C.) | — | — | 0.2 | C1(148° C.):0.2 | 100 | — | — |
| 10 | 25<br>75 | C1(148° C.)<br>C3(255° C.) | — | — | 0.25 | C1(148° C.):0.25 | 100 | — | — |
| 11 | 25<br>75 | C2(215° C.)<br>C3(255° C.) | — | — | 0.25 | J4(about 118° C.):0.125<br>A2(127° C.): 0.125 | 50<br>50 | — | — |
| 12 | 25<br>75 | G1(160° C.)<br>A3(230° C.) | — | — | 0.20 | J5(about 125° C.):0.1<br>J4(about 118° C.):0.025<br>C1(148° C.): 0.075 | 50<br>12.5<br>37.5 | — | — |

| Pressure Molding Condition | | | Compact | | | | |
|---|---|---|---|---|---|---|---|
| Die Preheating Temperature (° C.) | Heating Temperature of Iron-Based Mixed Powder (° C). | Temperature of Pressure Compacting (° C.) | Ejection Force (MPa) | Density (Mg/m$^3$) | Appearance | Sectional Microstructure | Remarks |
| 150 | 130 | 130 | 17 | 7.40 | Good | Good | Invention |
| 150 | 130 | 130 | 18 | 7.42 | Good | Good | Invention |
| 150 | 130 | 130 | 18 | 7.42 | Good | Good | Invention |
| 150 | 130 | 130 | 19 | 7.47 | Good | Good | Invention |
| 150 | 130 | 130 | 16 | 7.46 | Good | Good | Invention |
| 150 | 130 | 130 | 18 | 7.43 | Good | Good | Invention |
| 150 | 130 | 130 | 11 | 7.40 | Good | Good | Invention |
| 150 | 130 | 130 | 11 | 7.41 | Good | Good | Invention |

TABLE 1-1-continued

| | | | | | | | |
|---|---|---|---|---|---|---|---|
| 150 | 130 | 130 | 14 | 7.43 | Good | Good | Invention |
| 150 | 130 | 130 | 11 | 7.42 | Good | Good | Invention |
| 25 | 25 | 25 | 12 | 7.35 | Good | Good | Invention |
| 25 | 25 | 25 | 14 | 7.34 | Good | Good | Invention |

*Content relative to the entirety of lubricants

**Total content of lubricants in the iron-based mixed powder

***Content in the iron-based mixed powder

Reference numerals designating kinds of lubricants correspond to reference numerals as shown in Table 2

TABLE 1-2

| | Lubricant for Die Lubrication | | | | Lubricant for Powder Molding in Iron-Based Mixed Powder | | | | |
|---|---|---|---|---|---|---|---|---|---|
| | Lubricant Having Melting Point Higher Than Temperature of Pressure Molding | | Lubricant Having Low Melting Point Equivalent to or Lower Than Temperature of Pressure Molding | | | Lubricant Having Melting Point Higher Than Temperature of Pressure Molding | | Lubricant Having Low Melting Point Equivalent to or Lower Than Temperature of Pressure Molding | |
| Compact No. | Content* % by weight | Kind (Melting Point) | Content* % by weight | Kind (Melting Point) | Lubricant Content** % by weight | Kind (Melting Point): Content % by weight*** | Content* % by weight | Kind (Melting Point): Content % by weight*** | Content* % by weight |
| 13 | 30<br>70 | C2(215° C.)<br>C3(255° C.) | — | — | 0.3 | A4(216° C.):0.3 | 100 | — | — |
| 14 | 25<br>25<br>50 | C1(148° C.)<br>C2(215° C.)<br>C3(255° C.) | — | — | 0.2 | C2(215° C.):0.1<br>C3(255° C.):0.1 | 50<br>50 | — | — |
| 15 | 25<br>75 | C1(148° C.)<br>D1(220° C.) | — | — | 0.4 | A3(230° C.):0.3 | 75 | A2(127° C.):0.1 | 25 |
| 16 | 70<br>30 | C2(220° C.)<br>B1(144° C.) | — | — | 0.05 | E1(152° C.):0.05 | 100 | — | — |
| 17 | 70<br>30 | C2(220° C.)<br>E1(153° C.) | — | — | 0.2 | C1(148° C.):0.2 | 100 | — | — |
| 18 | 25<br>75 | C1(148° C.)<br>13(not fused) | — | — | 0.4 | C1(148° C.):0.4 | 100 | — | — |
| 19 | 50<br>50 | D1(220° C.)<br>D2(260° C.) | — | — | 0.2 | C1(148° C.):0.2 | 100 | — | — |
| 20 | 70<br>30 | D2(260° C.)<br>D3(215° C.) | — | — | 0.1 | F1(155° C.):0.1 | 100 | — | — |
| 21 | 60<br>40 | D3(215° C.)<br>E1(153° C.) | — | — | 0.4 | C3(255° C.):0.2 | 50 | A2(127° C.):0.1<br>C1(148° C.):0.1 | 25<br>25 |
| 22 | 55<br>45 | D3(215° C.)<br>B1(144° C.) | — | — | 0.35 | C1(148° C.): 0.175<br>A1(150° C.): 0.088 | 50<br>25 | A2(127° C.): 0.088 | 25 |

| Pressure Molding Condition | | | Compact | | | | |
|---|---|---|---|---|---|---|---|
| Die Preheating Temperature (° C.) | Heating Temperature of Iron-Based Mixed Powder (° C). | Temperature of Pressure Compacting (° C.) | Ejection Force (MPa) | Density (Mg/m$^3$) | Appearance | Sectional Microstructure | Remarks |
| 150 | 130 | 130 | 12 | 7.41 | Good | Good | Invention |
| 150 | 130 | 130 | 14 | 7.42 | Good | Good | Invention |
| 150 | 130 | 130 | 12 | 7.40 | Good | Good | Invention |
| 150 | 130 | 130 | 15 | 7.47 | Good | Good | Invention |
| 150 | 130 | 130 | 13 | 7.42 | Good | Good | Invention |
| 150 | 130 | 130 | 13 | 7.40 | Good | Good | Invenlion |
| 150 | 130 | 130 | 18 | 7.43 | Good | Good | Invention |
| 150 | 130 | 130 | 13 | 7.40 | Good | Good | Invention |
| 180 | 150 | 150 | 17 | 7.42 | Good | Good | Invention |
| 150 | 130 | 130 | 17 | 7.41 | Good | Good | Invention |

*Content relative to the entirety of lubricants

**Total content of lubricants in the iron-based mixed powder

***Content in the iron-based mixed powder

Reference numerals designating kinds of lubricants correspond to reference numerals as shown in Table 2

TABLE 1-3

| | Lubricant for Die Lubrication | | | | Lubricant for Powder Molding in Iron-Based Mixed Powder | | | | |
|---|---|---|---|---|---|---|---|---|---|
| | Lubricant Having Melting Point Higher Than Temperature of Pressure Molding | | Lubricant Having Low Melting Point Equivalent to or Lower Than Temperature of Pressure Molding | | | Lubricant Having Melting Point Higher Than Temperature of Pressure Molding | | Lubricant Having Low Melting Point Equivalent to or Lower Than Temperature of Pressure Molding | |
| Compact No. | Content* % by weight | Kind (Melting Point) | Content* % by weight | Kind (Melting Point) | Lubricant Content** % by weight | Kind (Melting Point): Content % by weight*** | Content* % by weight | Kind (Melting Point): Content % by weight*** | Content* % by weight |
| 23 | 60<br>40 | D3(215° C.)<br>F2(178° C.) | — | — | 0.25 | A1(150° C.):0.25 | 100 | — | — |
| 24 | 50<br>50 | B1(144° C.)<br>E1(153° C.) | — | — | 0.2 | D1(255° C.):0.2 | 100 | — | — |
| 25 | 50<br>50 | B1(144° C.)<br>I1(not fused) | — | — | 0.4 | D2(268° C.):0.4 | 100 | — | — |
| 26 | 30<br>70 | E1(153° C.)<br>I2(not fused) | — | — | 0.05 | D3(215° C.):0.05 | 100 | — | — |
| 27 | 30<br>30<br>40 | A3(230° C.)<br>C1(148° C.)<br>B1(144° C.) | — | — | 0.20 | C1(148° C.):0.20 | 100 | — | — |
| 28 | — | — | — | — | 0.4 | C1(148° C.):0.4 | 100 | — | — |
| 29 | 50 | C3(255° C.) | 50 | A2(127° C.) | 0.4 | C1(148° C.).0.4 | 100 | — | — |
| 30 | 100 | C3(255° C.) | — | — | 0.4 | C1(148° C.):0.4 | 100 | — | — |
| 31 | — | — | 100 | A2(127° C.) | 0.4 | C1(148° C.):.0.4 | 100 | — | — |
| 32 | — | — | — | — | 0.25 | J4(about 118° C.):0.125<br>A2(127° C.): 0.125 | 50<br>50 | — | — |
| 33 | 100 | A2(127° C.) | — | — | 0.25 | J5(about 125° C.):0.125<br>J4(about 118° C.):0.031<br>C1(148° C.): 0.094 | 50<br>12.5<br>37.5 | — | — |

| Pressure Molding Condition | | | Compact | | | | |
|---|---|---|---|---|---|---|---|
| Die Preheating Temperature (° C.) | Heating Temperature of Iron-Based Mixed Powder (° C.) | Temperature of Pressure Compacting (° C.) | Ejection Force (MPa) | Density (Mg/m$^3$) | Appearance | Sectional Microstructure | Remark |
| 150 | 130 | 130 | 16 | 7.42 | Good | Good | Invention |
| 150 | 130 | 130 | 16 | 7.42 | Good | Good | Invention |
| 150 | 130 | 130 | 14 | 7.40 | Good | Good | Invention |
| 150 | 130 | 130 | 17 | 7.46 | Good | Good | Invention |
| 150 | 130 | 130 | 16 | 7.43 | Good | Good | Invention |
| 150 | 130 | 130 | 35 | 7.31 | Flaw | Cavity | Conventional Example |
| 150 | 130 | 130 | 28 | 7.35 | Good | Good | Comparative Example |
| 150 | 130 | 130 | 25 | 7.33 | Good | Good | Comparative Example |
| 150 | 130 | 130 | 31 | 7.3 | Good | Good | Comparative Example |
| 25 | 25 | 25 | 32 | 7.20 | Flaw | Cavity | Conventional Example |
| 25 | 25 | 25 | 36 | 7.25 | Flaw | Good | Comparative Example |

*Content relative to the entirety of lubricants
**Total content of lubricants in the iron-based mixed powder
***Content in the iron-based mixed powder
Reference numerals designating kinds of lubricants correspond to reference numerals as shown in Table 2

TABLE 2

| Group | Reference Numeral | Kind of Lubricant | | Group | Reference Numeral | Kind of Lubricant | |
|---|---|---|---|---|---|---|---|
| Group A | A1<br>A2 | Calcium stearate<br>Zinc stearate | Metallic soap | Group C | C1 | Ethylene-bis-stearoamide | Amide-based wax |

TABLE 2-continued

| Group | Reference Numeral | Kind of Lubricant | | Group | Reference Numeral | Kind of Lubricant | |
|---|---|---|---|---|---|---|---|
| | A3 | Lithium stearate | | | C2 | Light Amide WH215 | |
| | A4 | Lithium hydroxystearate | | | | | |
| Group B | B1 | Straight chain low density polyethylene | Polyethylene | | C3 | Light Amide WH255 | |
| Group E | E1 | Polypropylene | Polypropylene | Group D | D1 | Polyamide 6 | Polyamide |
| Group G | G1 | Poly(methylmethacrylate) | Polymers comprised of methacrylic acid esters | | D2 | Polyamide 66 | |
| | G2 | Poly(ethylmethacrylate) | | | D3 | Polyamide 610 | |
| Group J | J1 | Eutectic mixture of Ethylene-bis-stearoamide and Polyethylene | Eutectic mixture | Group F | F1 | Poly(methylacrylate) | Polymer comprised of acrylic acid ester |
| | | | | | F2 | Poly(ethylacrylate) | |
| | | | | Group H | H1 | Polytetrafluoroethylene | Plastic including fluorine |
| | J2 | Eutectic mixture of Ethylene-bis-stearoamide and Zinc stearate | | Group I | I2 | $MoS_2$ | Layered lubricant |
| | | | | | I2 | Carbon Fluoride | |
| | J3 | Eutectic mixture of Ethylene-bis-stearoamide and Calcium stearate | | | I3 | Melamine-cyanuric acid adducts (MCA) | |
| | J4 | Eutectic mixture of Oleic acid and Zinc stearate | | | | | |
| | J5 | Eutectic mixture of Stearic acid amide and Ethylene-bis-stearic acid amide | | | | | |

Regarding each of the compacts according to the invention, the ejection forces after molding was as low as about 20 MPa or less, and the density was as high as about 7.30 $Mg/m^3$ or more in the ordinary temperature molding and was about 7.40 $Mg/m^3$ or more in the warm molding. In the compacts, defects such as flaws and fractures were not observed. The properties of sectional microstructure of the compact were normal, and no coarse cavities were observed.

Regarding the Conventional Examples (Compact Nos. 28 and 32) not subjected to the die lubrication, the ejection forces were increased to a great extent, the densities of the compacts were decreased, and flaws were observed on the surfaces of the compacts.

Regarding the Comparative Examples outside of the scope of the invention, the ejection forces were as high as more than 20 MPa, the densities in the ordinary temperature molding were as low as 7.25 $Mg/m^3$ or less, the densities in the warm molding were as low as 7.35 $Mg/m^3$ or less, flaws were observed on the surfaces of the compacts, or coarse cavities were observed in the vicinity of the surfaces of the cross sections of the compacts.

Regarding warm compaction, in cases in which the melting point of at least one kind of lubricant for die lubrication was equivalent to, or less than, the temperature of the compaction pressure (Compact No. 29), the lubricant for die lubrication was only one lubricant having a melting point higher than the temperature of the compaction pressure (Compact Nos. 30 and 33), or the lubricant for die lubrication was only one lubricant having a melting point lower than the temperature of the compaction pressure (Compact No. 31), the densities of the compacts were decreased, and the ejection forces were increased.

According to the invention, high-density compacts having excellent appearances and excellent sectional properties can be molded with decreased ejection forces.

According to the invention, industrially superior effects are exhibited. That is, high-density compacts having excellent appearances and excellent sectional properties can be produced by one time compacting, the ejection forces after molding can be decreased, lifetimes of the dies can be increased, and high-density sintered materials can be produced with ease.

What is claimed is:

1. A method of manufacturing a high-density iron-based powder compact, comprising placing an iron-based mixed powder into a die; and pressure molding the iron-based mixed powder at a predetermined temperature, wherein the die has the surface on which a lubricant for die lubrication is adhered by electrification, and a mixed powder comprising at least two different lubricants each having a melting point higher than the predetermined temperature of the compaction pressure is used as the lubricant for die lubrication.

2. The method of manufacturing a high-density iron-based powder compact according to claim 1, wherein the at least two different lubricants each having a melting point higher than the predetermined temperature of compaction pressure are at least two materials selected from the following groups:

group A: metallic soaps;

group B: polyethylenes;

group C: amide-based waxes;

group D: polyamides;

group E: polypropylenes;

group F: polymers comprised of acrylic acid esters;

group G: polymers comprised of methacrylic acid esters;

group H: plastics including fluorine; and group I: lubricants having layered crystal structures.

3. The method of manufacturing a high-density iron-based powder compact according to claim 2, comprising preheating the die and the iron-based mixed powder before the iron-based mixed powder is placed in the die.

4. An electrified lubricant for die lubrication, comprising:

a mixed powder of at least two different lubricants, each having a melting point higher than a predetermined temperature; wherein the lubricant for die lubrication adheres to the surface of a die by electrical force.

5. An electrified lubricant for die lubrication according to claim 4, wherein 90% or more of particles forming the lubricant for die lubrication have a particle diameter of about 50 $\mu$m or less.

6. An electrified lubricant for die lubrication, comprising:

a mixed powder of at least two different lubricants, each having a melting point higher than about 45° C., wherein the lubricant for die lubrication adheres to the surface of a die by electrical force.

7. An electrified lubricant for die lubrication, comprising:

a mixed powder of at least two different lubricants, each having a melting point higher than about 70° C., wherein the lubricant for die lubrication adheres to the surface of a die by electrical force.

8. An electrified lubricant for die lubrication, comprising:

a mixed powder of at least two different lubricants, each having a melting point higher than about 80° C., wherein the lubricant for die lubrication adheres to the surface of a die by electrical force.

9. An electrified lubricant for die lubrication, comprising:

a mixed powder of at least two different lubricants, each having a melting point higher than about 130° C., wherein the lubricant for die lubrication adheres to the surface of a die by electrical force.

10. An electrified lubricant for die lubrication according to claim 4, wherein the at least two different lubricants each having a melting point higher than a predetermined temperature are at least two materials selected from the following groups:

group A: metallic soaps;

group B: polyethylenes;

group C: amide-based waxes;

group D: polyamides;

group E: polypropylenes;

group F: polymers comprised of acrylic acid esters;

group G: polymers comprised of methacrylic acid esters;

group H: plastics including fluorine; and group I: lubricants having layered crystal structures.

11. An electrified lubricant for die lubrication according to claim 6, wherein the at least two different lubricants each having a melting point higher than a predetermined temperature are at least two materials selected from the following groups:

group A: metallic soaps;

group B: polyethylenes;

group C: amide-based waxes;

group D: polyamides;

group E: polypropylenes;

group F: polymers comprised of acrylic acid esters;

group G: polymers comprised of methacrylic acid esters;

group H: plastics including fluorine; and group I: lubricants having layered crystal structures.

12. A die wherein a lubricant is adhered to the surface of the die by electrification, the lubricant comprising a mixed powder of at least two different lubricants each having a melting point higher than a predetermined temperature of a compaction pressure applied to the die.

13. The die according to claim 12, wherein the at least two different lubricants each having a melting point higher than the predetermined temperature of the compaction pressure are at least two materials selected from the following groups:

group A: metallic soaps;

group B: polyethylenes;

group C: amide-based waxes;

group D: polyamides;

group E: polypropylenes;

group F: polymers comprised of acrylic acid esters;

group G: polymers comprised of methacrylic acid esters;

group H: plastics including fluorine; and group I: lubricants having layered crystal structures.

14. The die according to claim 13, wherein the die is a preheated die.

15. The die according to claim 12, wherein the die is a preheated die.

16. The die according to claim 12, wherein about 90% of particles forming the at least two different lubricants have a particle diameter of about 50 $\mu$m or less.

17. The method of manufacturing a higher density iron-based powder compact according to claim 1, wherein about 90% of particles forming the at least two different lubricants have a particle diameter of about 50 $\mu$m or less.

18. A method of lubricating a die, comprising:

providing a die having a molding surface;

providing a lubricant comprising a mixed powder of at least two different lubricants; and adhering the lubricant to the molding surface by electrification.

19. The method of lubricating a die according to claim 18, wherein the at least two different lubricants each having a melting point higher than a predetermined temperature of the pressure molding are at least two materials selected from the following groups:

group A: metallic soaps;

group B: polyethylenes;

group C: amide-based waxes;

group D: polyamides;

group E: polypropylenes;

group F: polymers comprised of acrylic acid esters;

group G: polymers comprised of methacrylic acid esters;

group H: plastics including fluorine; and group I: lubricants having layered crystal structures.

20. The method of lubricating a die according to claim 18, comprising preheating the die before placing an insert in the die.

21. An electrified lubricant for die lubrication, comprising:

a mixed powder of at least two different lubricants, each having a melting point higher than about 150° C., wherein the lubricant for die lubrication adheres to the surface of a die by electrical force.

22. An electrified lubricant for die lubrication, comprising:

a mixed powder of at least two different lubricants, each having a melting point higher than 200° C., wherein the lubricant for die lubrication adheres to the surface of a die by electrical force.

23. An electrified lubricant for die lubrication according to claim 7, wherein the at least two different lubricants each having a melting point higher than a predetermined temperature are at least two materials selected from the following groups:

group A: metallic soaps;

group B: polyethylenes;

group C: amide-based waxes;

group D: polyamides;

group E: polypropylenes;

group F: polymers comprised of acrylic acid esters;

group G: polymers comprised of methacrylic acid esters;

group H: plastics including fluorine; and group I: lubricants having layered crystal structures.

24. An electrified lubricant for die lubrication according to claim 8, wherein the at least two different lubricants each having a melting point higher than a predetermined temperature are at least two materials selected from the following groups:

group A: metallic soaps;

group B: polyethylenes;

group C: amide-based waxes;

group D: polyamides;

group E: polypropylenes;

group F: polymers comprised of acrylic acid esters;

group G: polymers comprised of methacrylic acid esters;

group H: plastics including fluorine; and group I: lubricants having layered crystal structures.

25. An electrified lubricant for die lubrication according to claim 9, wherein the at least two different lubricants each having a melting point higher than a predetermined temperature are at least two materials selected from the following groups:

group A: metallic soaps;

group B: polyethylenes;

group C: amide-based waxes;

group D: polyamides;

group E: polypropylenes;

group F: polymers comprised of acrylic acid esters;

group G: polymers comprised of methacrylic acid esters;

group H: plastics including fluorine; and group I: lubricants having layered crystal structures.

26. An electrified lubricant for die lubrication according to claim 21, wherein the at least two different lubricants each having a melting point higher than a predetermined temperature are at least two materials selected from the following groups:

group A: metallic soaps;

group B: polyethylenes;

group C: amide-based waxes;

group D: polyamides;

group E: polypropylenes;

group F: polymers comprised of acrylic acid esters;

group G: polymers comprised of methacrylic acid esters;

group H: plastics including fluorine; and group I: lubricants having layered crystal structures.

27. An electrified lubricant for die lubrication according to claim 22, wherein the at least two different lubricants each having a melting point higher than a predetermined temperature are at least two materials selected from the following groups:

group A: metallic soaps;

group B: polyethylenes;

group C: amide-based waxes;

group D: polyamides;

group E: polypropylenes;

group F: polymers comprised of acrylic acid esters;

group G: polymers comprised of methacrylic acid esters;

group H: plastics including fluorine; and group I: lubricants having layered crystal structures.

28. The method of manufacturing a high-density iron-based powder compact according to claim 1, wherein the die is not electrified.

29. The die according to claim 12, wherein the die is not electrified.

30. The method of lubricating a die according to claim 18, wherein the die is not electrified.

* * * * *